US007760226B2

(12) United States Patent
Atwood et al.

(10) Patent No.: US 7,760,226 B2
(45) **Date of Patent: *Jul. 20, 2010**

(54) ROS DESKEW MECHANISM WITH LINEAR ACTUATOR

(75) Inventors: Mark A Atwood, Honeoye Falls, NY (US); James P Calamita, Spencerport, NY (US)

(73) Assignee: Xerox Corporation, Norwalk, CT (US)

( * ) Notice: Subject to any disclaimer, the term of this patent is extended or adjusted under 35 U.S.C. 154(b) by 274 days.

This patent is subject to a terminal disclaimer.

(21) Appl. No.: 12/053,704

(22) Filed: Mar. 24, 2008

(65) Prior Publication Data

US 2009/0237484 A1 Sep. 24, 2009

(51) Int. Cl.
*B41J 15/14* (2006.01)
*B41J 27/00* (2006.01)

(52) U.S. Cl. ..... 347/242; 347/257

(58) Field of Classification Search ..... 347/116, 347/230, 241–244, 256–258, 245, 263
See application file for complete search history.

(56) References Cited

U.S. PATENT DOCUMENTS

| | | | | |
|---|---|---|---|---|
| 4,912,491 | A * | 3/1990 | Hoshino et al. | 347/116 |
| 5,072,244 | A * | 12/1991 | Aoki et al. | 347/116 |
| 6,982,736 | B2 * | 1/2006 | Okugawa et al. | 347/152 |
| 7,262,787 | B2 * | 8/2007 | Park | 347/263 |
| 2009/0237746 | A1 * | 9/2009 | Atwood et al. | 358/474 |

* cited by examiner

*Primary Examiner*—Hai C Pham
(74) *Attorney, Agent, or Firm*—James J. Ralabate

(57) ABSTRACT

In a color marking assembly, a series of ROS units are aligned above a photoconductive surface. These units have side mounts and a side positioned outboard linear actuator connecting them to this assembly. The inboard mounts are attached to a first inboard side of the ROS, and the outboard mounted linear actuators are attached to a second outboard side of the ROS unit. The inboard mount is an elongated bar extending beyond the height of the ROS unit. This elongated bar has hinged portions on both its top and bottom connections to the ROS unit. The linear actuator that is positioned on the outboard side of the ROS unit has a rigid sphere resting in a V-housing in a V-block. This actuator configuration and the board mount enable the ROS unit to be easily deskewed when required to provide improved vibration-free images.

15 Claims, 6 Drawing Sheets

ROS DESKEW MECHANISM WITH LINEAR ACTUATOR

CROSS REFERENCE

Illustrated and disclosed in a co-pending application Ser. No. 12/053,753 owned by the present assignee is an application relating to ROS deskew mechanism with a linear motor and mechanism. The U.S. patent application Ser. No. 12/053,753 is filed in the US Patent and Trademark Office on the same date as the present application which is based upon Ser. No. 12/053,704. The disclosure of Ser. No. 12/053,753 is totally incorporated herein by reference.

This invention relates to an electrophotographic color system and more specifically for a ROS mount used in these systems to improve color image registration.

BACKGROUND

In one color system, an array or series of different color imaging stations are aligned above an endless belt. Each imaging station contains a raster output scanner (ROS), photoreceptor drum, development station, and cleaning station. The ROS emits an electronic beam (laser) which impinges on the rotating photoconductive drum, thereby causing that location on the drum to undergo a change in electrical charge. As the drum continues to rotate past the development station, toner particles of a color which is unique to that imaging station will attach to the drum at the location charged by the ROS. This colored image is then transferred to an intermediate transfer belt that is passing by, and in contact with, the photoreceptor drum. As the intermediate belt passes by the different imaging stations (each usually containing a different color) it picks up subsequent color layers to create a complete color image which is then transferred to media.

Each colored beam must be in substantial registration with the other beams deposited on the belt for a final color copy. If any color needs to be re-aligned or skewed, the ROS unit is moved accordingly. In one embodiment there are also two sensors (Mark On Belt, or MOB sensors) that are fixed in position to a point on the machine frame, such that the colored images pass within view of these sensors. These sensors serve to detect the misregistration or misalignment between colors. The actuation of the deskew portion of the correction is performed via a ROS mechanism such as in of this invention. Each ROS unit has its own motor so that it could independently be skewed for image alignment. This type of color system having an array of ROS units is generally described in U.S. Pat. No. 6,418,286 and is incorporated by reference into this disclosure. As noted above, the color image deposited on the drum is subsequently deposited onto the belt. As the drum continues to rotate, it passes through the development station with a latent image which causes toner to stick to the drum where the electrical discharging (by the ROS) has taken place. The drum further rotates until the image is in contact with this intermediate transfer belt where the image is transferred from the drum to the belt. Each of the six or plurality of imaging stations deposits its own color and subsequently movement of the belt is moved past each of the imaging stations and allows each of the color separations to be deposited in turn. Thus, when the colors are out of alignment, the image needs to be skewed as does the image beam. By placing registration images side by side on the intermediate belt, the MOB sensors will indicate how much each ROS needs to be skewed to provide the optimum color-to-color registration deposited on the belt by the six or several ROS units.

One of the problems encountered is that the prior art mountings of the ROS are not robust to vibration sources within the imaging system, thereby causing "banding". These prior art mountings are susceptible to vertical vibration which generally causes imprecise image deposition. By "banding" is meant a series of dark and light image lines causing image quality defects or color variations. The present invention involves an improved ROS mounting and skew adjustment mechanism. In typical prior art ROS mounting—the spheres and arms are located in the bottom portion of the ROS in line with the focal point of the ROS beam.

As noted above, generally, these prior art ROS mountings are positioned at the bottom lower end of the ROS, usually in the form of arms, one on each lower side of the ROS. Each arm is adjacent to a mounting sphere, which lie along the focal point axis. This allows the ROS to pivot about the focal axis without affecting focus itself. Reuse of this prior art configuration, especially in more compact future systems requires a need to locate the mounting spheres off axis. This presents a problem of how to mount the ROS such that it isn't overconstrained and has the degree of freedom needed to permit proper deskewings of the beam when necessary. For image registration purposes, the ROS beam needs to be deskewed in order to align its image with the image of the other colors being written on the belt.

SUMMARY OF THE INVENTION

Generally, in the present invention the prior arm and sphere mountings located below the ROS unit are removed and replaced on one side with side mountings and a linear actuator motor on the other side. Rather than locate the inboard mountings below the ROS units, inboard mountings of the present invention are placed on an inboard side of the ROS. While a rotary motor is used on the outboard side in the prior art ROS assemblies, the present invention uses a specific linear stepper motor or actuator which will be described below.

The outboard arrangement in the unit of this invention has a linear slide mounted to the ROS frame. This linear slide is driven by a linear actuator. Built into the movable portion of the linear slide is a V-block. The outboard end of the ROS with a rigid sphere attached is supported by the movable V-block.

As earlier noted in some ROS color systems a cantilevered motorized cam is used in each ROS unit for deskewing. In some prior art, using a motorized am in the deskewing system there was structural resonance of the ROS in the 70-80 Hz range. This structural resonance very often was the cause of banding (image quality defect) because of the vibration in the system. The present invention provides a solution to this banding by replacing the motorized cam (or rotary motors) used with a linear stepper motor or linear actuator and mechanism. This linear actuator is supported on a V-block having a sphere in the V, and by traveling linearly rather than using a rotary motor.

This linear actuator motor is used on the outboard side of the ROS while the inboard side has specific side mounts to assist in the vibration reduction.

The robustness of the design of the present invention with side inboard mountings and a linear actuator motor on the ROS outboard side will limit image defects due to vibration. The inboard mount comprises a vertical bar connected to the top and bottom of the inboard side of the ROS. Each connection is in the form of a hinge where the ROS essentially pivots like a door on two hinges as it is deskewed.

Present configuration—Because of hardware space constraints, the lower positioned prior art arms that held the ROS unit need to be removed and the mounting spheres located away from the focal point of the ROS. The mounting hardware allows the present invention to do this while rigidly holding the ROS but not over-constraining it.

On the outboard side of the ROS, the prior art used motorized cam is replaced with a linear actuator motor and slide mechanism which allow the ROS unit to be deskewed relative to the photoreceptor. As noted, together with the new inboard side mounting, the linear actuator motor overcomes a structural resonance in the 70-80 Hz range. The inboard mount is mounted such that it is not over constrained, while still maintaining proper orientation of the entire ROS.

DETAILED DISCUSSION OF DRAWINGS AND PREFERRED EMBODIMENTS

Figure 1:
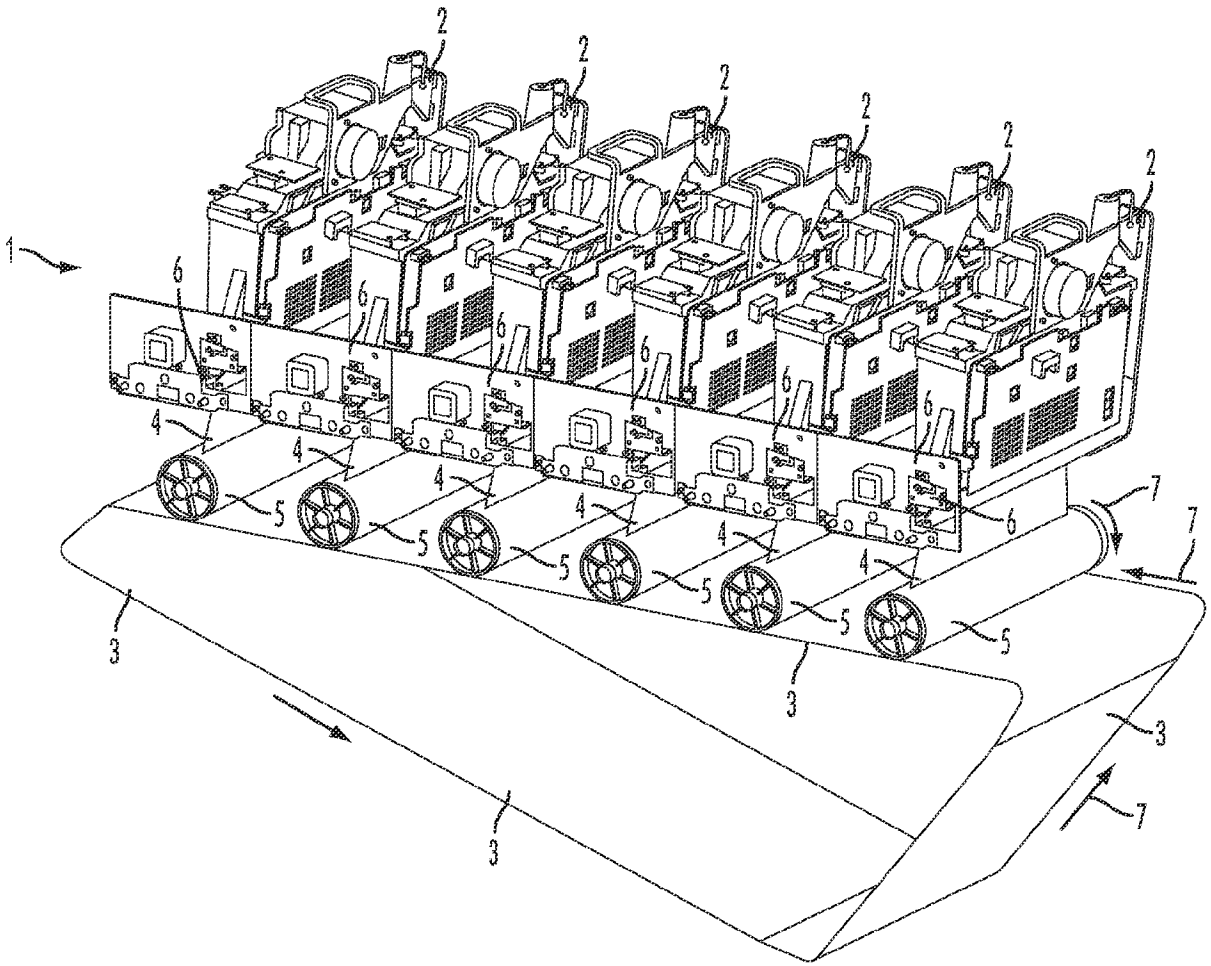
FIG. 1 is an isometric view of a 6-station intermediate belt transfer xerographic system where the ROS mounts and the linear actuator motor of the present invention can be used.

In FIG. 1, a color imaging system 1 where the deskewing mechanism of the present invention may be used is illustrated having an array of raster output scanners (ROS) 2 and their associated photoreceptor drums 5 aligned above an endless intermediate transfer belt 3. Each ROS emits a different image beam 4 on a photoconductive drum 5 to charge the drum's surface where the image for that color will be located. As the drum 5 rotates, the charged regions pick up toner of the color for that particular imaging station and transfer this color image to the surface of the belt 3 so that each colored image is deposited in relation to the previous deposited image. At the end of the process, all six deposited images (that are color developed at each station) are precisely aligned to form the final color image which is eventually transferred to media. The arrows 7 indicate the rotation direction of drum 5 and belt 3. At location 8, the linear actuator used in the present invention is generally shown.

A typical xerographic imaging system useful in the present invention and employing ROS units, as above described, is disclosed in U.S. Pat. No. 6,418,286B1. This patent disclosure is incorporated by reference into the present disclosure.

It is in the above type xerographic imaging systems such as that shown in FIG. 1 that the novel ROS mountings and linear actuator permit secure of this invention are used. The present mountings and linear actuator deskewing operation while at the same time eliminating the vibration disadvantages of the prior art.

Figure 2A:
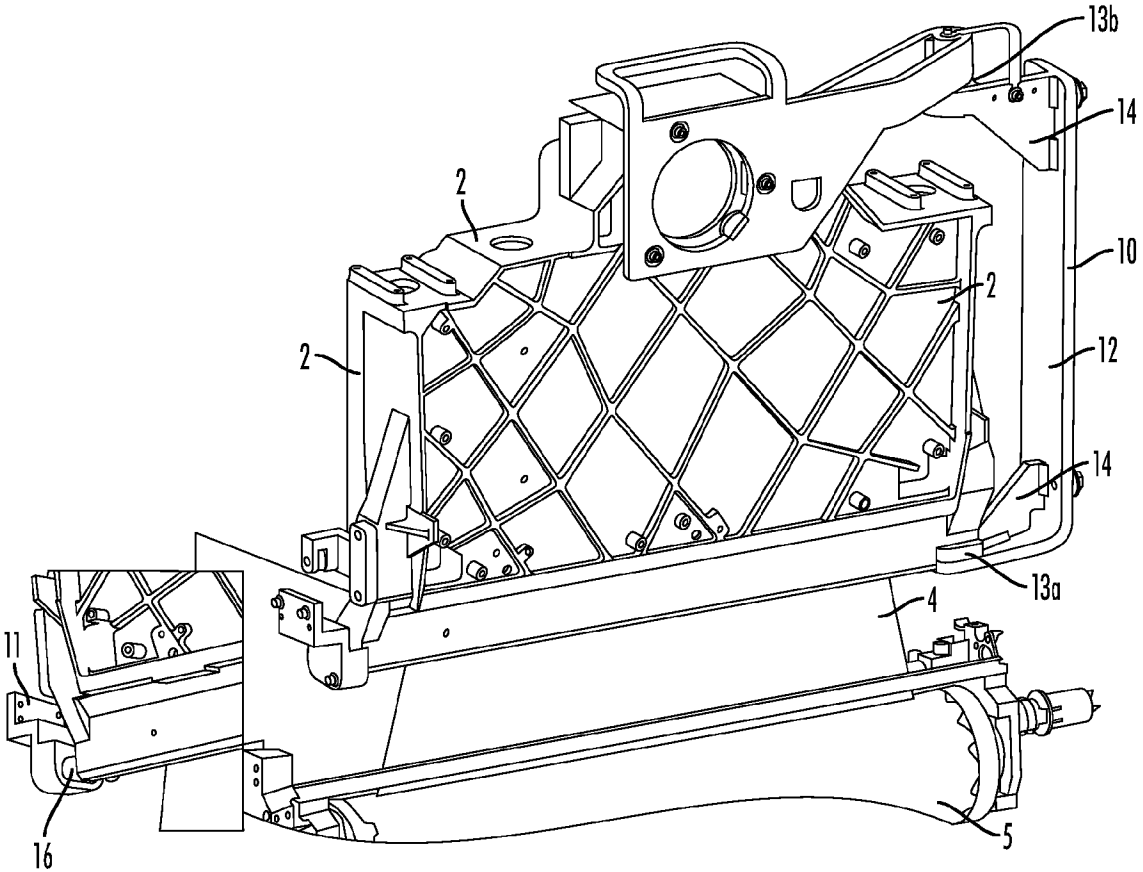
FIG. 2A is a perspective view showing the new inboard ROS mounting on one side and in FIG. 2B the new linear actuator located on the outboard side of the ROS.

In FIG. 2A, an embodiment of the side inboard mountings of the present invention are illustrated. On one side, (the inboard side) is located the inboard mounting 10 and on the opposite outboard side is located linear actuator 8. This actuator has a rigid sphere fitted into a slide having a v-shaped housing for the rigid sphere to rest. The inboard mounting 10 comprises an elongated bar 12 that extends vertically beyond the height of ROS 2. At each end of bar 12 are pivots 13*a* and 13*b* which permit the ROS 2 to be moved easily when deskewing occurs, similar to the hinges on a door. The lower pivot 13*a* is constrained in x, y and z translation directions and the upper inboard pivot 13*b* is constrained such that constrains rotation of the ROS units about the z-axis, but is free to move in the other axes as part tolerances require. This inboard mounting is free from obstructing the beam 4 when deskewing and imaging while securely fixing the ROS 2 in place. On each end of bar 12 are gussets 14 attached to the bar 12 to decrease deflections that would allow ROS to move.

Figure 2B:
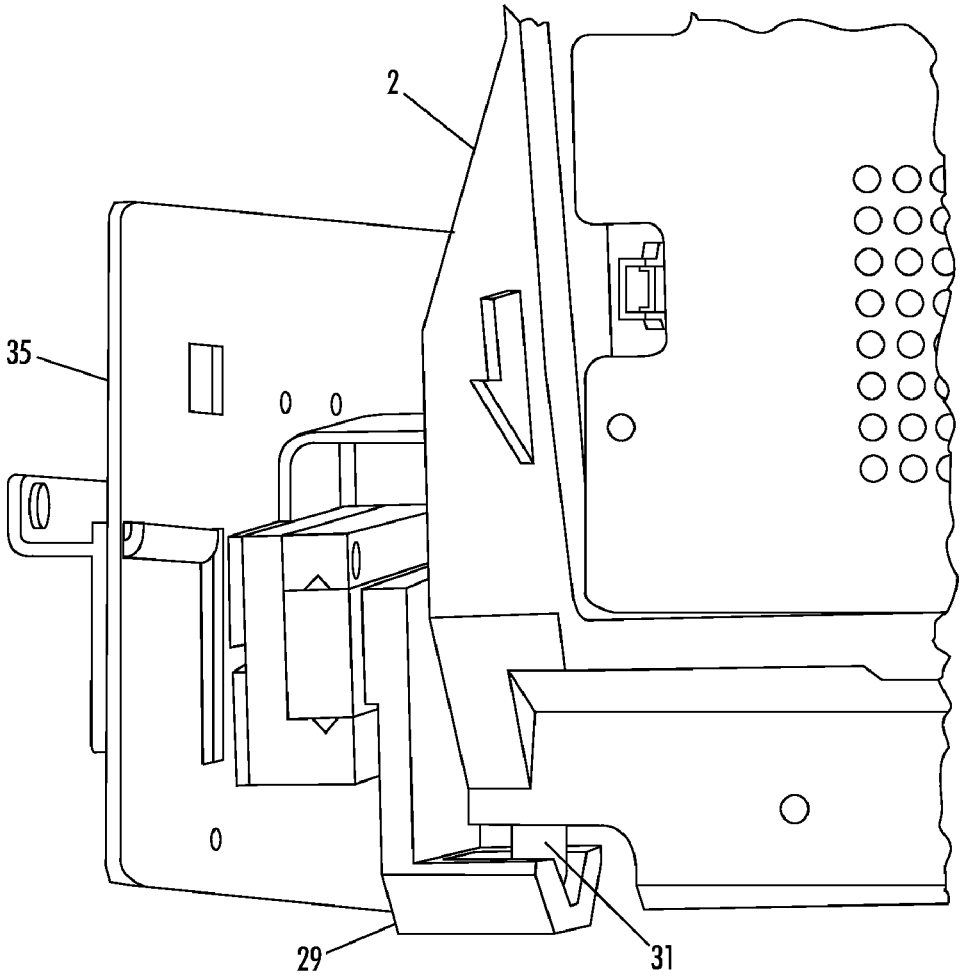
Figure 3:
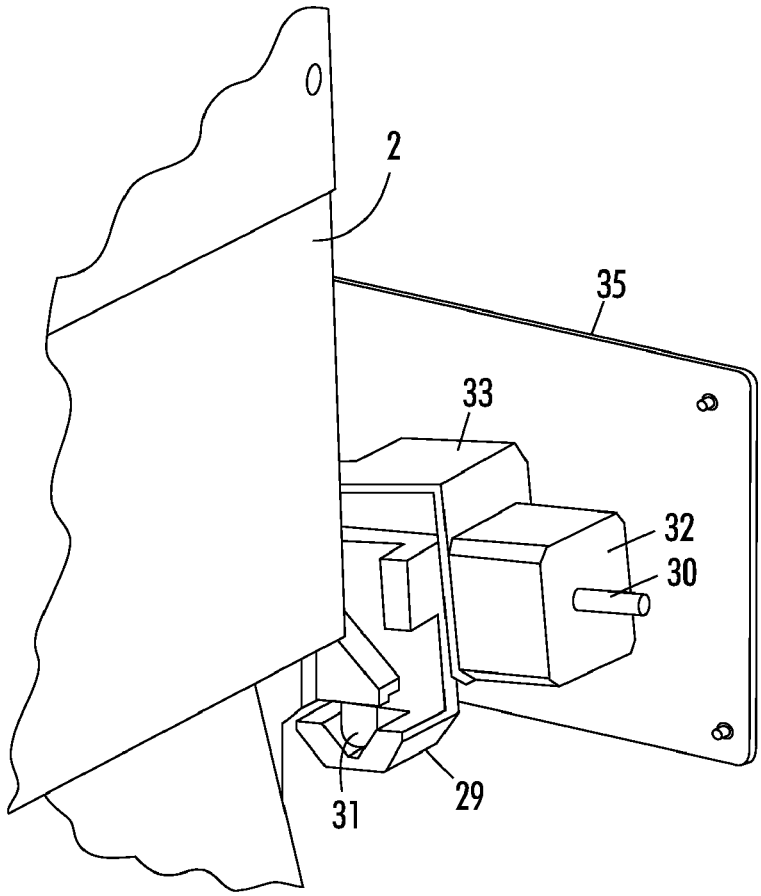
FIG. 3 is a perspective view of the ROS outboard side with the linear actuator connected thereto.
Figure 4:
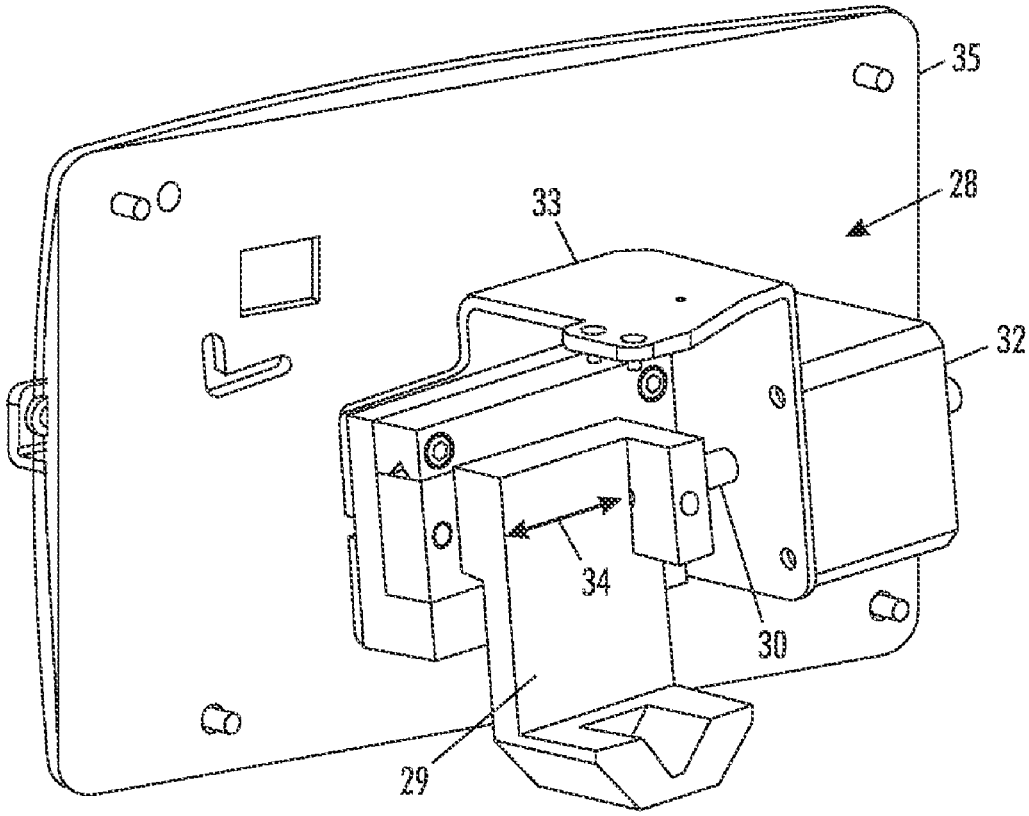
FIG. 4 is a close up perspective view of the V-block portion of an embodiment of the linear actuator used in the present invention.

On the outboard ROS side, partially shown in an embodiment of FIG. 2B, 3 and FIG. 4 in an exploded view, is the linear actuator 28 of this invention as connection to ROS.

In FIGS. 2B, 3 and 4, the only part that moves is the V-slide (V-Block) 29. It travels +/−3 mm to enable deskew. The motor shaft 30 does not turn; it translates in and out of the motor. The outer OB sphere 31 on the ROS 2 rest in the V-Block 29. A V-Block is required because the OB sphere 31 travels in an arc as the IB of the ROS 2 pivots about its axis. So the sphere 31 needs to have that degree of freedom. Even though it's a very small amount, it needs to travel along the V. This design is very stiff since nothing is cantilevered. Effects from vibration will be very small. The motor 32 is attached to the bracket 33. The V-Block 29 moves +/−3 mm along the slide axis as shown by direction arrows 34.

Figure 5A:
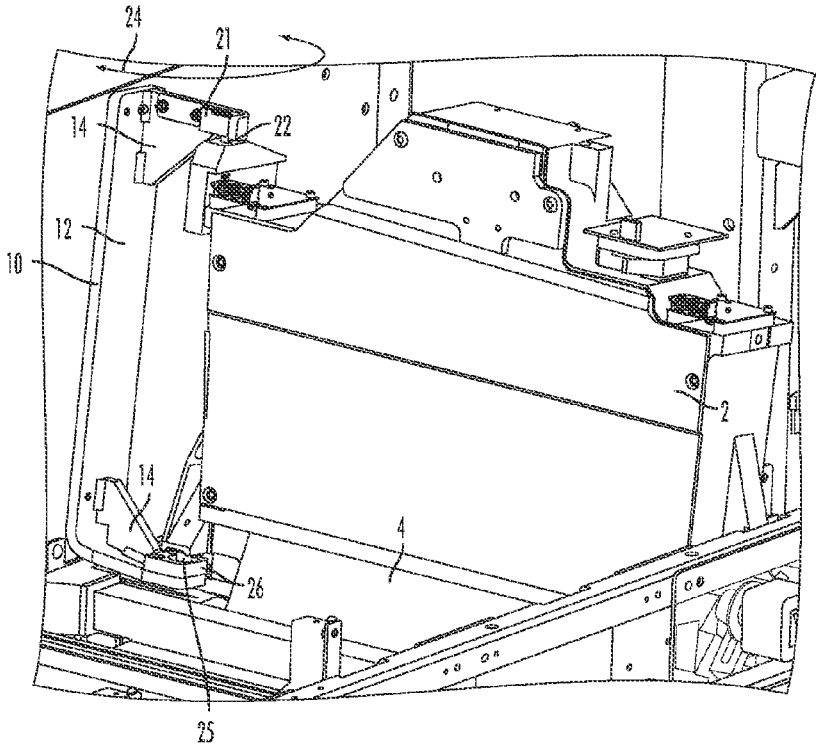
FIG. 5A shows an embodiment of an inboard mounting of the present invention as it is attached to the ROS unit.
Figure 5B:
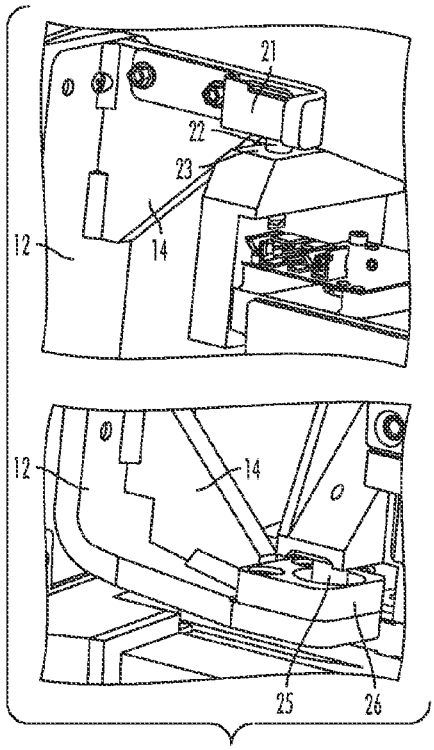
FIG. 5B shows specifics of this inboard mounting, both at its top and a bottom sections.

In FIGS. 5A and 5B, specifics of inboard mounting 10 are illustrated. At the top gusset 14 is located a spring retainer 21 which clamps the movable ball 22 in place on flat surface 23. The arrow 24 shows the movement of the ROS 2 on inboard mounting 10 via inboard upper mounting sphere 22. At the bottom of inboard mounting 10 is located a sphere 25 which rests in a socket 26 and acts as a pivot and locating feature for ROS 2 when deskewing. Thus, in one embodiment, inboard mounting 10 has a bar 12 with sphere 22 (top) and sphere 25 (bottom) of bar 12. This new mounting with inboard mount 10 and outboard mount 11 allows the ROS 2 to be easily deskewed relative to the photoreceptor or photoconductors with the advantage of overcoming structural resonance in the 60-90 Hz range exhibited when the system 1 is operational.

As shown in FIG. 5A, the invention provides a bracket with a sphere 22 attached to it and is added to the top of the casting to create an additional pivot point which is in line with the lower inboard sphere. This establishes an axis which is perpendicular to the plane of motion created by the outboard ball bearing and the inboard lower pivot point. When the spheres are mounted, this axis becomes a hinge point to deskew the ROS about. Additional parts on the OB side of the ROS are needed to rigidly support it and to allow deskewing of the beam. The ROS essentially pivots like a door on two hinges as it is deskewed.

In summary, this invention provides a raster output scanner (ROS) unit comprising an image beam emitting ROS unit, an inboard mount attached to a first side of the ROS unit, a linear actuator motor attached to a second outboard side of the ROS unit. Both the inboard mount and the outboard motor are positioned so that they will not interfere with a beam emitted from the ROS unit. The inboard mount comprises an elongated bar extending away from and beyond a height of the ROS unit.

The bar has hinged portions on both its upper and lower terminal portions or ends and each are pivotally mounted on the ROS unit. The outboard side has mounted linear actuator. This linear actuator and the inboard mount are adapted to enable the ROS unit and its ROS beam to be easily deskewed when required. Any suitable linear actuator may be used in the present invention such as the Haydon Model 47000. This actuator is mounted on a V-Block with a sphere resting in the V housing mount comprises a sphere or ball bearing and locating block configuration. This configuration and the inboard mount are enabled to enable the ROS unit and its ROS beam to be easily deskewed when required.

In the ROS unit, the inboard mount has a sphere-socket configuration on the lower terminal portion and a sphere-surface configuration on the upper terminal portion. The inboard mount has a spring retainer on the upper terminal portion. This retainer is enabled to capture the sphere in place and is enabled to permit free pivoting of the ROS unit when deskewing.

In one embodiment, the inboard mount comprises an elongated bar extending at the first side of the ROS unit and beyond a height of the ROS unit. The bar is connected to the ROS unit at both the upper and lower terminal portions at a top and bottom side portion of the ROS unit. The bar comprises a spring retainer and inboard upper mounting sphere-surface-spring retainer configuration at a top ROS connection. The bar comprises at its bottom side portion an inboard lower mounting sphere housed in a socket.

The inboard mount and the linear actuator (on outboard side) are enabled to minimize the effects of vibration of the ROS within the electrophotographic marking system and thereby are enabled to improve the quality of an image from the ROS unit. As noted, the inboard mount has a spring retainer on its upper portion. This retainer is enabled to hold an inboard upper mounting sphere movably in place and is enabled to permit free pivoting of the ROS unit during a deskewing operation.

The marking assembly where the present mount and actuator are used comprises an endless photoconductive belt in operative arrangement with a photoconductive drum. The drum is enabled to be in operative contact with the electronic beam and is adapted to receive the beam in a latent image configuration. The marking assembly has a development system enabled with the drum to develop this latent image and transfer this developed image to the endless photoconductive belt. The marking assembly has a plurality of these marking units and they are aligned along the photoconductor belt. Each of the units is enabled to develop the latent image in a different color than the other of the aligned units.

It will be appreciated that several of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. A raster output scanner (ROS) unit for use in an electrophotographic marking system comprising:

an image beam emitting ROS unit, an inboard mount attached to a first side of the ROS unit, an outboard positioned linear actuator motor mounted on a V-block-sphere to a second side of said ROS unit; both said inboard mount and said outboard positioned linear actuator being positioned so that they will not interfere with a beam emitted from said ROS unit, said inboard mount comprising an elongated bar extending away from and beyond a height of said ROS unit, said bar having hinged portions on both its upper and lower terminal portions or ends and each pivotally mounted on said ROS unit, said outboard positioned linear actuator motor mounted to a linear slide with movable V-block with a rigid sphere resting in said block having a V-shaped groove configuration, said configuration along with said inboard mount configured to permit said ROS unit and its ROS beam to be easily deskewed without vibration, when required.

2. The unit of claim 1 wherein said inboard mount has a sphere-socket configuration on said lower terminal portion and a sphere-surface configuration on said upper terminal portion.

3. The unit of claim 1 wherein said inboard mount has a spring retainer on said upper terminal portion, said retainer configured to capture said sphere in place, and configured to permit free pivoting of said ROS unit when deskewing.

4. The unit of claim 1 wherein said inboard mount comprises:

said bar being connected to said ROS unit at both said upper and lower terminal portions at a top and bottom side portion of said ROS unit, said bar comprising a spring retainer and inboard upper mounting sphere-surface-spring retainer configuration at a top ROS connection, and said bar comprising at its bottom side portion an inboard lower mounting sphere housed in a socket.

5. The unit of claim 1 wherein said inboard mount and said linear actuator mounted to a linear slide with movable V-block are configured to minimize the effects of vibration within said ROS in said electrophotographic marking system and thereby configured to improve a quality of an image from said ROS unit.

6. A beam emitting ROS unit for use in a xerographic marking system comprising:

a side connected inboard mount that is configured to secure said ROS unit to a xerographic station in said marking system, said inboard mount comprising an upper inboard mount extending at the side of said ROS unit and extending beyond a height of said ROS unit, a lower inboard mount positioned in a bottom portion of said unit and providing a pivot axis for said unit, a linear actuator motor mounted to a linear slide with movable V-block on an outboard side of said ROS unit, said V-block having a V-shaped housing for a rigid sphere to rest therein, said block and said sphere both configured to move horizontally and configured to substantially reduce any adverse vibration effect on said beam and said ROS during an imaging and marking process.

7. The assembly of claim 6 wherein adjacent to and in operative connection to hinges in said inboard mount are positioned ball bearings, said ball bearings configured to cooperate with said hinges in moving said ROS unit in a deskewing operation.

8. The assembly of claim 6 wherein said inboard mount has a spring retainer on its upper portion, said retainer configured to hold an inboard upper mounting sphere movably in place and configured to permit free pivoting of said ROS unit during a deskewing operation.

9. The assembly of claim 6 wherein said inboard mount comprises:

said bar being connected to said ROS unit at both a top connection and bottom side portion and connection of said ROS unit, said bar comprising a spring retainer and inboard upper mounting sphere-surface-spring retainer configuration at said top connection, and comprising at its bottom side portion an inboard lower mounting sphere housed in a socket, said socket attached to said elongated bar.

10. The assembly of claim 6 wherein said inboard mount and said linear actuator motor mounted to a linear slide are configured to minimize vibration from moveable components of an electrophotographic marking system and thereby configured to improve a quality of an image from said ROS unit.

11. A beam emitting ROS marking unit for use in a xerographic marking assembly comprising:

an inboard mount and an outboard positioned linear actuator configured to secure said ROS unit to a xerographic station of said marking assembly, said inboard mount extending at the side of ROS unit and extending beyond a height of said ROS unit, said linear actuator mounted to linear slide with a movable V-block in bottom portion of said ROS unit and providing power for said ROS unit, said inboard mount comprising an elongated bar having hinges at both its upper and lower sections, said hinges movably attached to said unit; said unit configured to emit an electronic imaging beam at a location between said mount and said linear actuator, said inboard mount and said linear actuator configured to substantially reduce any adverse vibration effects on said beam during an imaging and marking process, said assembly further comprising an endless photoconductive belt and having at least one photoconductive drum configured to receive said beam in a latent image configuration, said assembly having a development system configured to develop said latent image and transfer this developed image to said endless photoconductive belt.

12. The assembly of claim 11 wherein a plurality of said beam emitting ROS units are aligned along said endless photoconductor belt, each of said units configured to develop said latent image in a different color than the other of said aligned units.

13. The assembly of claim 11 wherein adjacent to and in operative connection to each of said hinges in said inboard mount are positioned mounting spheres, said spheres configured to cooperate with said linear actuator and with said hinges in moving said unit in a deskewing operation.

14. The assembly of claim 11 wherein said inboard mount has a spring retainer on its upper portion, said retainer configured to hold a mounting sphere movably in place and configured to permit free pivoting of said ROS unit during a deskewing operation.

15. The assembly of claim 11 wherein said inboard mount comprises:

said bar being connected to said ROS unit at both a top connection and bottom side portion of said ROS unit, said bar comprising a spring retainer and mounting sphere-track configuration at said top connection, and comprising at its bottom side portion a mounting sphere housed in a socket, said socket attached to said ROS unit.

* * * * *